US009409696B2

(12) United States Patent
Carse

(10) Patent No.: US 9,409,696 B2
(45) Date of Patent: Aug. 9, 2016

(54) MULTI-CHAMBER CONTAINER

(71) Applicant: COLGATE-PALMOLIVE COMPANY, New York, NY (US)

(72) Inventor: Paul Donald Carse, Milford, NJ (US)

(73) Assignee: Colgate-Palmolive Company, New York, NY (US)

( * ) Notice: Subject to any disclaimer, the term of this patent is extended or adjusted under 35 U.S.C. 154(b) by 0 days.

(21) Appl. No.: 14/443,601

(22) PCT Filed: Nov. 19, 2012

(86) PCT No.: PCT/US2012/065750
§ 371 (c)(1),
(2) Date: May 18, 2015

(87) PCT Pub. No.: WO2014/077844
PCT Pub. Date: May 22, 2014

(65) Prior Publication Data
US 2015/0274399 A1 Oct. 1, 2015

(51) Int. Cl.
*B65D 25/08* (2006.01)
*B65D 81/32* (2006.01)
(Continued)

(52) U.S. Cl.
CPC ..... *B65D 81/3288* (2013.01); *B65D 35/22* (2013.01); *B65D 35/242* (2013.01);
(Continued)

(58) Field of Classification Search
CPC ..... B65D 25/08; B65D 5/24; B65D 35/22; B65D 35/242; B65D 81/3283; B65D 81/3288
USPC ..... 206/219–222, 568; 215/6, DIG. 8; 222/129, 145.5, 145.6, 153.14, 207
See application file for complete search history.

(56) References Cited

U.S. PATENT DOCUMENTS 1,848,846 A 3/1932 Schell
2,876,935 A * 3/1959 Lindberg ..... F41H 9/10 222/145.5

(Continued)

FOREIGN PATENT DOCUMENTS

GB 1 180 427 2/1970
JP S6197139 6/1986

(Continued)

OTHER PUBLICATIONS

International Search Report and the Written Opinion of the International Searching Authority issued in International Application PCT/US2012/065750 mailed Jul. 29, 2013.

*Primary Examiner* — Luan K Bui

(57) ABSTRACT

Provided is a multi-chamber container for dispensing flowable substances, comprising: a body having: a first storage chamber for storing a first flowable substance, a second storage chamber for storing a second flowable substance, a mixing chamber, a first inlet that fluidly connects the first storage chamber with a first portion of the mixing chamber, and a second inlet that fluidly connects the second storage chamber with a second portion of the mixing chamber; and a closure having a divider, wherein the closure is movable relative to the body between: (a) a first position, at which the divider isolates the first portion of the mixing chamber from the second portion of the mixing chamber and the closure is spaced from the first and second inlets, and (b) a second position, at which the first portion of the mixing chamber is in fluid communication with the second portion of the mixing chamber.

24 Claims, 7 Drawing Sheets

(51) Int. Cl.

| | |
|---|---|
| ***B65D 35/22*** | (2006.01) |
| ***B65D 35/24*** | (2006.01) |
| ***B65D 35/44*** | (2006.01) |
| ***B65D 43/16*** | (2006.01) |
| ***B65D 43/22*** | (2006.01) |
| ***B65D 51/24*** | (2006.01) |

(52) U.S. Cl.
CPC ..... *B65D 35/44* (2013.01); *B65D 43/16* (2013.01); *B65D 43/22* (2013.01); *B65D 51/24* (2013.01); *B65D 81/325* (2013.01); *B65D 81/3283* (2013.01)

(56) References Cited

U.S. PATENT DOCUMENTS

| | | | | | |
|---|---|---|---|---|---|
| 3,347,420 | A | * | 10/1967 | Donoghue | G01F 11/286 222/129 |
| 3,581,940 | A | * | 6/1971 | Cella | B05B 11/0078 222/94 |
| 3,729,553 | A | | 4/1973 | Gold | |
| 4,065,536 | A | | 12/1977 | Lucas | |
| 4,077,547 | A | | 3/1978 | Donoghue | |
| 4,279,349 | A | | 7/1981 | Aigner | |
| 4,964,539 | A | | 10/1990 | Mueller | |
| 5,154,917 | A | | 10/1992 | Ibrahim | |
| 5,356,040 | A | * | 10/1994 | Reggiani | B05B 11/3084 215/6 |
| 5,482,170 | A | | 1/1996 | Semersky | |
| 5,573,143 | A | | 11/1996 | Deardurff | |
| 5,593,065 | A | | 1/1997 | Harrold | |
| 5,740,947 | A | | 4/1998 | Flaig et al. | |
| 5,899,360 | A | | 5/1999 | Mack | |
| 5,975,364 | A | | 11/1999 | Kaufman | |
| 6,343,716 | B1 | | 2/2002 | Baudin et al. | |
| 2003/0121936 | A1 | * | 7/2003 | De Laforcade | B65D 81/32 222/145.5 |
| 2004/0149775 | A1 | | 8/2004 | Chen | |
| 2007/0029275 | A1 | * | 2/2007 | Hantman | B29C 49/0078 215/6 |
| 2007/0253761 | A1 | * | 11/2007 | May | B29C 45/0046 206/219 |
| 2011/0315574 | A1 | * | 12/2011 | Lee | A45D 34/00 206/219 |
| 2014/0346062 | A1 | * | 11/2014 | Bukhari | A47G 19/2227 206/219 |

FOREIGN PATENT DOCUMENTS

| | | |
|---|---|---|
| JP | 2003128109 | 5/2003 |
| JP | 201469866 | 4/2014 |
| WO | WO 2011/056173 | 5/2011 |
| WO | WO 2012/082138 | 6/2012 |

* cited by examiner

MULTI-CHAMBER CONTAINER

CROSS-REFERENCE TO RELATED PATENT APPLICATIONS

This application is a U.S. national stage application under 35 U.S.C. §371 of PCT Application No. PCT/US2012/65750, filed Nov. 19, 2012, the entirety of which is incorporated herein by reference.

FIELD OF THE INVENTION

The present invention relates to a multi-chamber container. The multiple chambers of the container may store respective flowable substances, for example, respective oral care products such as mouthwashes or respective components of a mouthwash.

BACKGROUND OF THE INVENTION

A multi-chamber container is a container having more than one chamber for storing respective substances out of contact with one another. It may be desirable to keep the respective substances out of contact with one another during storage of the respective substances, for example if the substances might react or deteriorate over time should they be allow to mix.

Over the years, efforts have been made to improve the design of multi-chamber containers to try to prevent, during dispensing of two substances from respective chambers of the container, a first of the substances from a first of the chambers flowing into a second of the chambers holding a second of the substances causing inadvertent mixing of the substances. For example, it is known to provide a two-compartment container with two discharge openings, each leading to a respective one of the compartments, and rib members between the discharge openings to hinder a substance from the first compartment flowing into the second compartment during dispensing of the substances.

Despite these efforts, a need still exists for multi-chamber container with a structure that better prevents, during dispensing of two substances from respective chambers of the container, a first of the substances stored in a first of the chambers flowing into a second of the chambers storing a second of the substances.

SUMMARY OF THE INVENTION

A first aspect of the present invention provides a multi-chamber container for dispensing flowable substances, comprising: a body having: a first storage chamber for storing a first flowable substance, a second storage chamber for storing a second flowable substance, a mixing chamber, a first inlet that fluidly connects the first storage chamber with a first portion of the mixing chamber, and a second inlet that fluidly connects the second storage chamber with a second portion of the mixing chamber; and a closure having a divider, wherein the closure is movable relative to the body between: (a) a first position, at which the divider isolates the first portion of the mixing chamber from the second portion of the mixing chamber and the closure is spaced from the first and second inlets, and (b) a second position, at which the first portion of the mixing chamber is in fluid communication with the second portion of the mixing chamber.

Preferably, when the closure is at the first position, the closure isolates the mixing chamber from an exterior of the container. Preferably, when the closure is at the second position, the mixing chamber is in fluid communication with the exterior of the container.

The mixing chamber may include an interior wall having a groove for receiving a portion of the divider when the closure is at the first position.

Optionally, when the closure is at the second position, the mixing chamber is free of the divider.

Preferably, the mixing chamber is defined by a wall, and each of the first and second inlets comprises a protrusion protruding into the mixing chamber, the protrusion having an internal passage in fluid communication with a respective one of the first and second storage chambers, which passage opens into the mixing chamber at an opening formed in the protrusion at a position spaced from the wall.

Optionally, when the closure is at the second position, the closure is attached to the body. The closure may be attached to the body by a hinge. Alternatively, when the closure is at the second position, the closure is detached from the body. The container may comprise a lock for locking the closure at the first position.

Optionally, the container comprises a first dip tube extending from the first inlet to the first storage chamber and a second dip tube extending from the second inlet to the second storage chamber.

The first and second storage chambers may be defined by respective first and second vessels that are squeezable by a user to cause the first and second flowable substances to flow into the mixing chamber.

The first and second storage chambers may be defined by respective non-unitary first and second vessels. The mixing chamber may be defined by a third vessel that is non-unitary with the first and second vessels and that is attached to the first and second vessels.

Optionally, the container comprises a base that is non-unitary with the first and second vessels, wherein the first and second vessels are disposed between the third vessel and the base. Preferably, the first and second vessels are disposed in parallel between the third vessel and the base.

The container may comprise a first member movable between a closed position, at which the first member seals the first inlet to isolate the first storage chamber from the mixing chamber, and an open position, at which the first storage chamber is in fluid communication with the mixing chamber, and a second member movable between a closed position, at which the second member seals the second inlet to isolate the second storage chamber from the mixing chamber, and an open position, at which the second storage chamber is in fluid communication with the mixing chamber, wherein, when the closure is at the first position, the first and second members are prevented from moving to their respective closed positions.

Preferably, when the closure is at the first position, the closure contacts the first and second members to prevent the first and second members from moving to their respective closed positions. Preferably, when the closure is at the second position, the first and second members are movable to their respective closed positions. The first and second members may be biased to their respective closed positions. Optionally, the first member comprises a first piston disposed in the first inlet and the second member comprises a second piston disposed in the second inlet.

Preferably, the container comprises a first apparatus configured, on operation thereof, to dispense from the first storage chamber via the first inlet into the first portion of the mixing chamber a first predetermined volume of the first flowable substance. Preferably, the container comprises a second apparatus configured, on operation thereof, to dispense from the second storage chamber via the second inlet into the second portion of the mixing chamber a second predetermined volume of the second flowable substance.

The closure may comprise a first cavity and a second cavity, wherein the divider separates the first cavity from the second cavity. Preferably, when the closure is at the first position, the first portion of the mixing chamber is in fluid communication with the first cavity of the closure and the second portion of the mixing chamber is in fluid communication with the second cavity of the closure.

The container may comprise a first apparatus configured, on operation thereof, to dispense from the first storage chamber via the first inlet into the first portion of the mixing chamber a first predetermined volume of the first flowable, substance and a second apparatus configured, on operation thereof, to dispense from the second storage chamber via the second inlet into the second portion of the mixing chamber a second predetermined volume of the second flowable substance.

Preferably, the first cavity has a first volume equal to or greater than the first predetermined volume, and the second cavity has a second volume equal to or greater than the second predetermined volume.

DETAILED DESCRIPTION OF THE PREFERRED EMBODIMENTS

Figure 1:
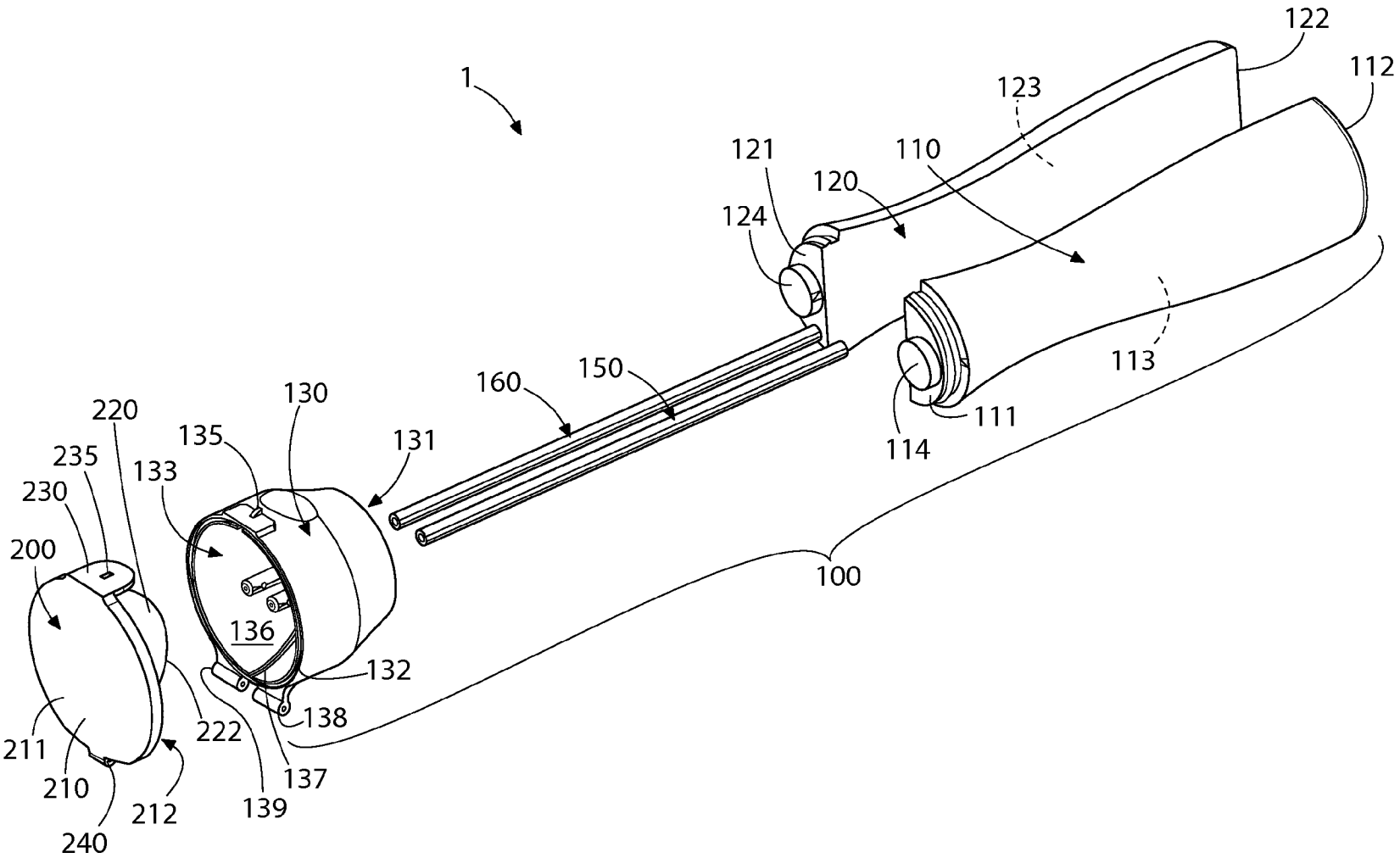
FIG. 1 is an exploded view of components of a multi-chamber container according to a first embodiment of the present invention.

The following description of the preferred embodiments is merely exemplary in nature and is in no way intended to limit the invention, its application, or uses. The description of illustrative embodiments according to principles of the present invention is intended to be read in connection with the accompanying drawings, which are to be considered part of the entire written description. In the description of embodiments of the invention disclosed herein, any reference to direction or orientation, is merely intended for convenience of description and is not intended in any way to limit the scope of the present invention. Relative terms such as "lower," "upper," "horizontal," "vertical," "above," "below," "up," "down," "top" and "bottom" as well as derivative thereof (e.g., "horizontally," "downwardly," "upwardly," etc.) should be construed to refer to the orientation as then described or as shown in the drawing under discussion. These relative terms are for convenience of description only and do not require that the apparatus be constructed or operated in a particular orientation unless explicitly indicated as such. Terms such as "attached," "affixed," "connected," "coupled," "interconnected," and similar refer to a relationship wherein structures are secured or attached to one another either directly or indirectly through intervening structures, as well as both movable or rigid attachments or relationships, unless expressly described otherwise. Moreover, the features and benefits of the invention are illustrated by reference to the preferred embodiments. Accordingly, the invention expressly should not be limited to such preferred embodiments illustrating some possible non-limiting combination of features that may exist alone or in other combinations of features.

A multi-chamber container for dispensing flowable substances and according to a first embodiment of the present invention will be described with reference to FIGS. 1 to 3.

The container 1 of the first embodiment comprises a body 100 and a closure 200. The body 100 comprises first and second storage chambers 113, 123 each for storing a flowable substance, or each storing a flowable substance, such as a liquid or a paste. The first and second storage chambers 113, 123 are defined by respective first and second vessels 110, 120 that have respective orifices 114, 124 at a first small end 111, 121 thereof. Each of the first and second vessels 110, 120 has a second small end 112, 122 at an end opposite to the first small end 111, 121 thereof. Together, the second small ends 112, 122 may be considered to form a base end of the container 1. Each of the first and second vessels 110, 120 is elongate between its first and second small ends. The first and second vessels 110, 120 are made from a flexible, preferably resilient, material, whereby each of the first and second vessels 110, 120 is squeezable by a user to cause the first and second flowable substances to flow out from the respective first and second storage chambers 113, 123 through the respective orifices 114, 124.

The first and second vessels 110, 120 are non-unitary. That is, the first and second vessels 110, 120 are not integrally formed together, but instead are separate components that are connected together during assembly of the container 1. In a variation to the illustrated embodiment, the first and second storage chambers 113, 123 may be defined as separate compartments in a single, unitary vessel.

The body 100 further comprises a third vessel 130 that is non-unitary with the first and second vessels 110, 120 and that is attached to the first and second vessels 110, 120 during assembly of the container 1. More specifically, during assembly of the multi-chamber container 1, the first and second vessels 110, 120 are brought into contact with each other, their respective first small ends 111, 121 and orifices 114, 124 are inserted into a receiving hole 131 formed in a first side of the third vessel 130, and then the respective first small ends 111, 121 of the first and second vessels 110, 120 are fixed to the third vessel 130, such as by adherence using adhesive or by sonic welding the third vessel 130 to the first and second vessels 110, 120. Accordingly, in the assembled container 1, the first and second storage chambers 113, 123 are disposed in parallel between the second small ends 112, 122 and the third vessel 130, as shown in FIG. 2.

In a variation to the described embodiment, the container 1 may further comprise a base (not shown) that is non-unitary with the first and second vessels 110, 120 wherein, in the assembled container 1, the first and second vessels 110, 120 are disposed in parallel between the third vessel 130 and the base.

The third vessel 130 has a wall 136 defining a mixing chamber 133. In this embodiment, the wall 136 defining the mixing chamber 133 is substantially hemispherical. However, in variations to this embodiment, the wall 136 may take a different shape. Indeed, in some embodiments, the wall 136 may be comprised of a set of, optionally polygonal, sub-walls that together define the mixing chamber 133. The mixing chamber 133 is sized to receive a divider 220 of the closure 200 when the closure 200 is at a first, closed position relative to the body 100, as will be discussed in more detail below. Moreover, the wall 136 has a groove 137 for receiving an edge 222 of the divider 220 of the closure 200 when the closure 200 is at a first, closed position relative to the body 100. The mixing chamber 133 can be considered to comprise a first portion 133*a* (or first outlet zone 133*a*) and a second portion 133*b* (or second outlet zone 133*b*) that meet at the groove 137 with the first and second portions 133*a*, 133*b* together forming the mixing chamber 133.

In variations to the described embodiment, the groove 137 may be omitted, and the divider 220 of the closure 200 may have an edge 222 that is cooperable with the wall 136 of the third vessel 130 to isolate the first portion 133*a* of the mixing chamber 133 from the second portion 133*b* of the mixing chamber 133.

Figure 2:
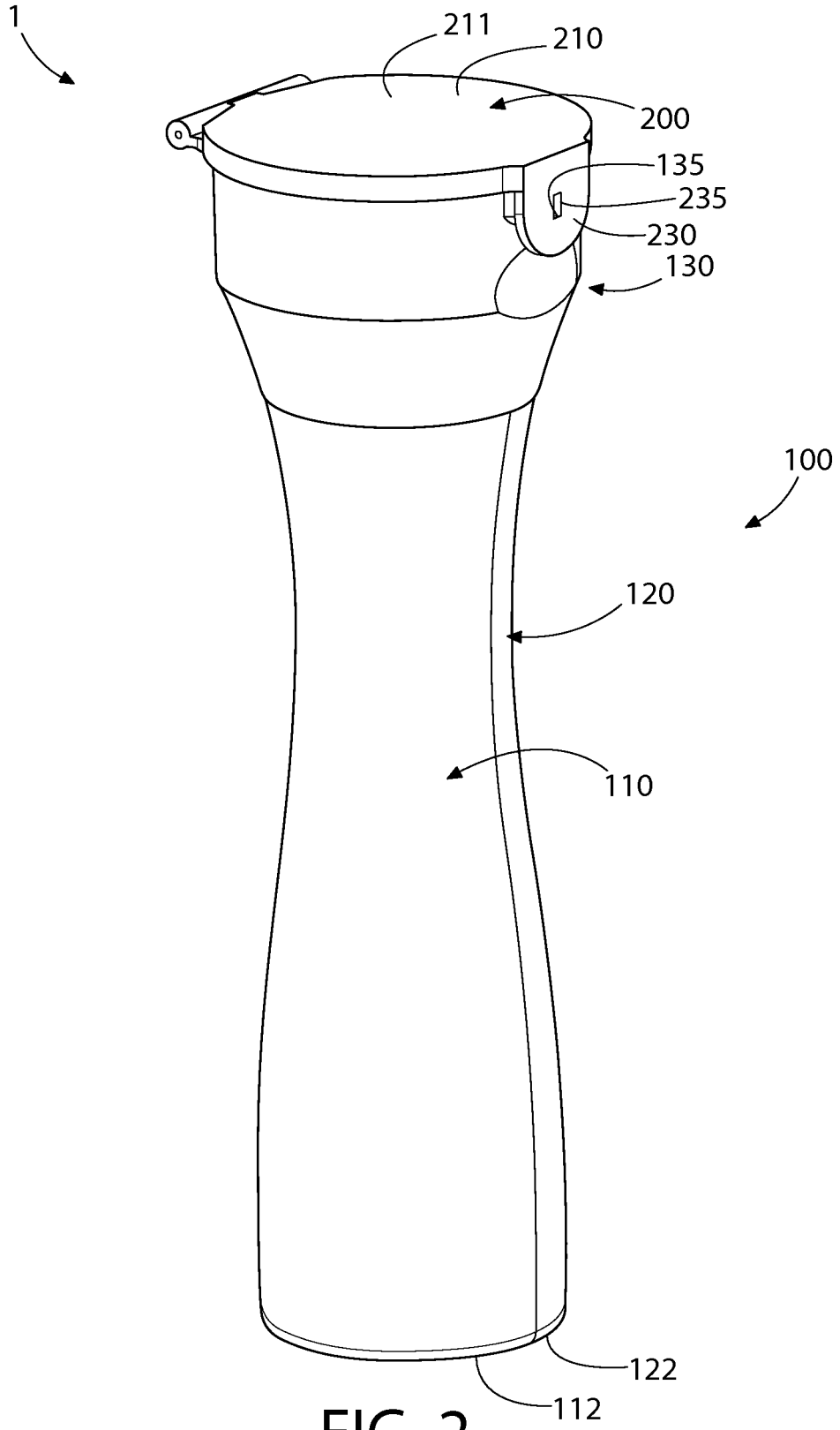
FIG. 2 is a perspective view showing the components of FIG. 1 assembled to form the multi-chamber container according to the first embodiment of the present invention, shown with the closure of the container at its first, closed position relative to the body of the container.
Figure 3:
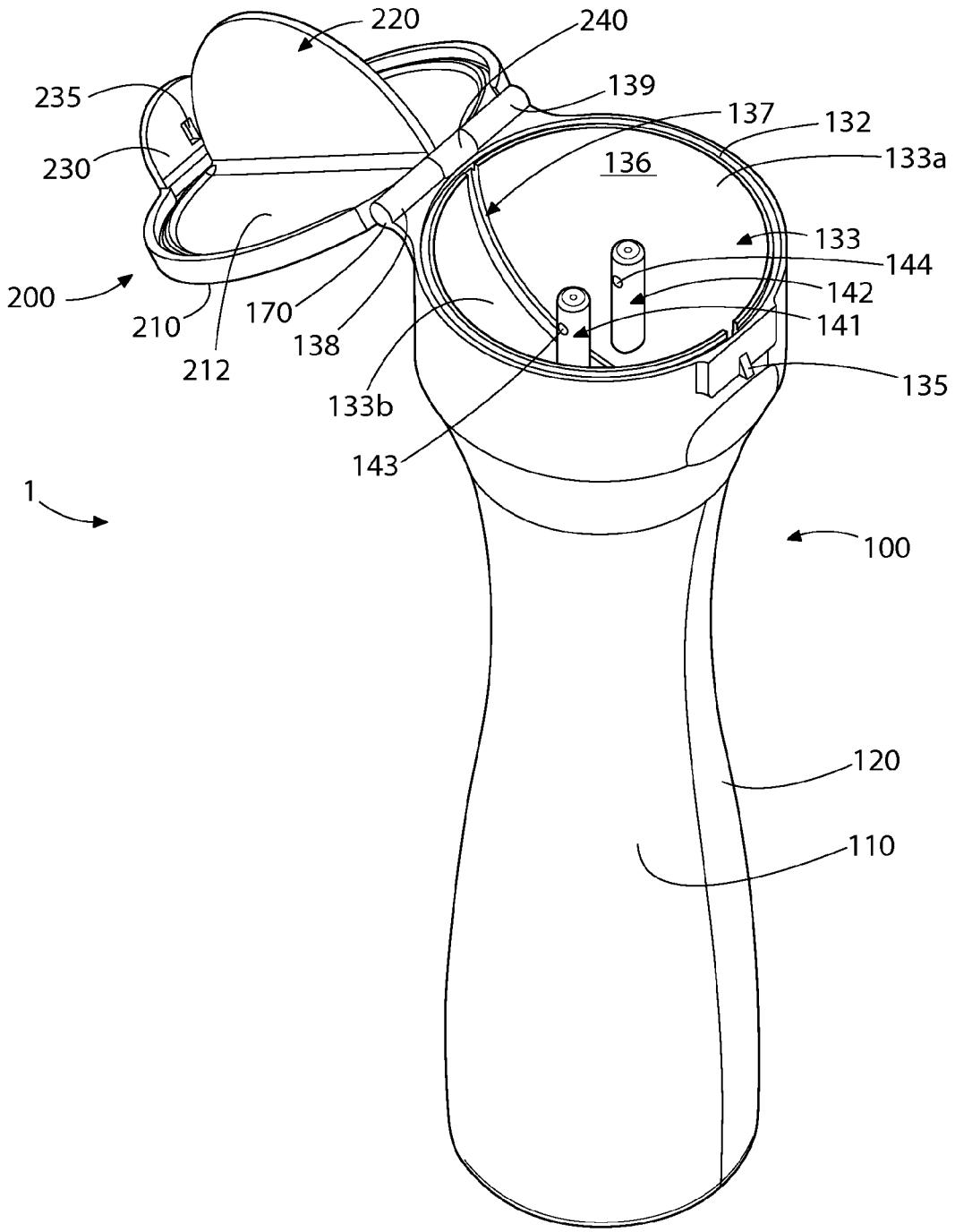
FIG. 3 is a perspective view of the multi-chamber container of FIG. 2, shown with the closure of the container at its second, open position relative to the body of the container.

With reference to both FIGS. 1 and 3, first and second protrusions 141, 142 protrude into the mixing chamber 133. The first protrusion 141 is part of a first inlet that fluidly connects the first storage chamber 113 with the mixing chamber 133, while the second protrusion 142 is part of a second inlet that fluidly connects the second storage chamber 123 with the mixing chamber 133. More specifically, the first inlet fluidly connects the first storage chamber 113 with the first portion 133*a* (or first outlet zone) of the mixing chamber 133 when the divider 220 isolates the first portion 133*a* from the second portion 133*b* (or second outlet zone), while the second inlet fluidly connects the second storage chamber 123 with the second portion 133*b* of the mixing chamber 133 when the divider 220 isolates the first portion 133*a* from the second portion 133*b*.

The first protrusion 141 has a first internal passage in fluid communication with the first storage chamber 113, which first internal passage opens into the mixing chamber 133 at a first opening 143 in the first protrusion 141 at a position spaced from the wall 136, while the second protrusion 142 has a second internal passage in fluid communication with the second storage chamber 123, which second internal passage opens into the mixing chamber 133 at is second opening 144 in the second protrusion 142 at a position spaced from the wall 136. The distance between the first opening 143 and the wall 136 determines a first predetermined volume of the first flowable substance to be held in the first portion 133*a* of the mixing chamber 133, and the distance between the second opening 144 and the wall 136 determines a second predetermined volume of the second flowable substance to be held in the second portion 133*b* of the mixing chamber 133. Accordingly, as will be described further below, the container 1 comprises a first apparatus configured, on operation thereof, to dispense from the first storage chamber 113 via the first inlet into the first portion 133*a* of the mixing chamber 133 a first predetermined volume of the first flowable substance, and a second apparatus configured, on operation thereof, to dispense from the second storage chamber 123 via the second inlet into the second portion 133*b*of the mixing chamber 133 a second predetermined volume of the second flowable substance.

The container 1 further comprises respective first and second dip tubes 150, 160. The first dip tube 150 extends from the first inlet, through the orifice 114 of the first vessel 110, and into the first storage chamber 113 of the first vessel 110. Similarly, the second dip tube 160 extends from the second inlet, through the orifice 124 of the second vessel 120, and into the second storage chamber 123 of the second vessel 120.

As mentioned above, the container 1 further comprises a closure 200. The closure 200 is attached to the body 100 by a hinge 170 comprising first and second barrels 138, 139 of the third vessel 130, a third barrel 240 of the closure 200 disposed between and axially aligned with the first and second barrels 138, 139, and a pin extending though the first, second and third barrels 138, 139, 240. In a variation to this embodiment, the hinge 170 may take a different form. For example, the hinge 170 may be a living hinge, and the closure 200 may be unitary with the third vessel 130. Nevertheless, in such an embodiment, the closure 200 still would be movable relative to the third vessel 130 and the rest of the body 100.

The closure 200 has a main portion 210 having a first exterior side 211 and a second interior side 212, and a divider 220 extending from the interior side 212. The divider 220 has a semicircular edge 222 that is locatable in the groove 137 in the wall 136 of the third vessel 130.

The closure 200 is movable relative to the body 100 between a first, closed position (see FIG. 2) and a second, open position (see FIG. 3). A lock, comprising a projection 135 projecting from an outer surface of the third vessel 130 and a hole 235 formed in a lug 230 extending from an edge of the main portion 210 of the closure 200, is provided for locking the closure 200 at the first, closed position. When the closure 200 is at the first, closed position, the projection 135 is disposed in the hole 235, to obstruct movement of the closure 200 relative to the body 100 from the first, closed position to the second, open position. The lug 230 is flexible to withdraw the projection 135 from the hole 235 to permit movement of the closure 200 relative to the body 100 to the second, open position. Other forms of lock for locking the closure 200 at the first, closed position may instead be provided.

When the closure 200 is at the first, closed position, the main portion 210 of the closure 200 creates a seal with a rim or lip 132 of the third vessel 130 around an opening of the mixing chamber 133 to isolate the mixing chamber 133 from an exterior of the container 1. Moreover, when the closure 200 is at the first, closed position, the divider 220 is disposed in the mixing chamber 133 with the edge 222 of the divider 220 located in the groove 137, and the divider 220 isolates the first portion 133*a* of the mixing chamber 133 from the second portion 133*b* of the mixing chamber 133. Furthermore, when the closure 200 is at the first, closed position, the entire closure 200, including the divider 220, is spaced from the first and second inlets, i.e. from the first and second protrusions 141, 142 and their respective openings 143, 144, so as to permit flow of the first flowable substance from the first storage chamber 113 via the opening 143 of the first protrusion 141 into the first portion 133*a* of the mixing chamber 133, and so as to permit flow of the second flowable substance from the second storage chamber 123 via the opening 144 of the second protrusion 142 into the second portion 133*b* of the mixing chamber 133.

On the other hand, when the closure 200 is at the second, open position, the main portion 210 of the closure 200 is separated from the rim or lip 132 of the third vessel 130, and the mixing chamber 133 is in fluid communication with the exterior of the container 1. Moreover, when the closure 200 is at the second, open position, the closure 200 remains attached to the third vessel 130 via the hinge 170, but the mixing chamber 133 is free of the divider 220, and the first portion 133*a* of the mixing chamber 133 is in fluid communication with the second portion 133*b* of the mixing chamber 133.

In a variation to the described embodiment, the closure 200 may not be connected to the third vessel 130 via a hinge, but may instead be detachable from the third vessel 130 and the rest of the body 100 when moving the closure 200 from the first, closed position to the second, open position. In such a variation, when the closure 200 is at the second position, the closure 200 is detached from the body 100.

When a user wishes to dispense the first and second flowable substances, they first ensure that the closure 200 is at the first, closed position and, preferably, that the projection 135 is disposed in the hole 235 to engage the lock. Then, while the container 1 is in a horizontal state, that is either with the base end of the container 1 on a horizontal surface or otherwise while holding the container 1 in such a manner that the base end of the container 1 is horizontal, and with the base end of the container 1 lower than, i.e. below, the closure 200, the user applies inwardly-directed opposing forces to the first and second vessels 110, 120 to squeeze the first and second vessels 110, 120 and to cause the first and second flowable substances to flow out from the respective first and second storage chambers 113, 123, through the respective first and second orifices 114, 124, through the respective first and second dip tubes 150, 160, and through the respective first and second openings 143, 144 of the first and second protrusions 141, 142 of the first and second inlets into the respective first and second portions 133*a*, 133*b* of the mixing chamber 133, which first and second portions 133*a*, 133*b* of the mixing chamber 133 are isolated from each other by the divider 220 of the closure 200.

While maintaining the container 1 in the horizontal state with the base end of the container 1 lower than the closure 200, the user then releases the applied forces, which allows any portion of the first flowable substance in the first portion 133*a* of the mixing chamber 133 that is disposed above the first opening 143 (that is, disposed closer to the closure 200 than the first opening 143) to flow back to the first storage chamber 113 via the first opening 143, and an portion of the second flowable substance in the second portion 133*b* of the mixing chamber 133 that is disposed above the second opening 144 (that is, disposed closer to the closure 200 than the second opening 144) to flow back to the second storage chamber 123 via, the second opening 144. Accordingly, it is ensured that all that remains in the first portion 133*a* of the mixing chamber 133 is the first predetermined volume of the first flowable substance, and all that remains in the second portion 133*b* of the mixing chamber 133 is the second predetermined volume of the second flowable substance.

While the foregoing description discusses the use of the container 1 in a horizontal state, it is understood that the user may also use the container 1 even if the container 1 is not in a horizontal state, such as using the container 1 when it is slightly tilted with respect to the base of the container 1.

The user then moves the closure 200 to the second, open position relative to the body, which withdraws the divider 220 from the groove 137 and brings the first portion 133*a* (or first outlet zone) of the mixing chamber 133 and the first predetermined volume of the first flowable substance therein into fluid communication with the second portion 133*b* (or second outlet zone) of the mixing chamber 133 and the second predetermined volume of the second flowable substance therein. Accordingly, the first and second predetermined volumes of the respective first and second flowable substances are then allowed to mix in the mixing chamber 133.

The user then brings the lip or rim 132 of the third vessel 130 to their lips, tilts the container 1, and pours the mixture of the first and second predetermined volumes of the respective first and second flowable substances into their mouth.

Accordingly, since the respective upper surfaces of the first and second flowable substances in the respective first and second portions 133*a*, 133*b* of the mixing chamber 133 fall below the respective first and second openings 143, 144 prior to mixing of the first and second flowable substances in the mixing chamber 133, it is prevented, or the risk is minimized, that any of the first flowable substance is allowed to flow towards the second storage chamber 123 via the second opening 144, and that any of the second flowable substance is allowed to flow towards the first storage chamber 113 via the first opening 143.

A multi-chamber container for dispensing flowable substances and according to a second embodiment of the present invention will be described with reference to FIGS. 4 to 7. Like elements in FIGS. 1 to 3 and FIGS. 4 to 7 are indicated with like reference numerals.

The container 1, of the second embodiment comprises a body 100 and a closure 200. The body 100 comprises first and second storage chambers 113, 123 each for storing a flowable substance, or each storing a flowable substance, such as a liquid or a paste. The first and second storage chambers 113, 123 are defined by respective first and second vessels 110, 120 that have respective orifices 114, 124 at a first small end 111, 121 thereof. Each of the first and second vessels 110, 120 has a second small end 112, 122 at an end opposite to the first small end 111, 121 thereof. Each of the first and second vessels 110, 120 is elongate between its first and second small ends. The first and second vessels 110, 120 are made from a hard, preferably rigid, material. However, in a variation to this embodiment, the first and second vessels 110, 120 may be made from a flexible, preferably resilient, material, whereby each of the first and second vessels 110, 120 is squeezable by a user to cause the first and second flowable substances to flow out from the respective first and second storage chambers 113, 123 through the respective orifices 114, 124.

The first and second vessels 110, 120 are non-unitary. That is, the first and second vessels 110, 120 are not integrally formed together, but instead are separate components that are connected together during assembly of the container 1. In a variation to the illustrated embodiment, the first and second storage chambers 113, 123 may be defined as separate compartments in a single, unitary vessel.

The container 1 also comprises a base 180 that is non-unitary with the first and second vessels 110, 120. The base 180 has an exterior base end 182, and an interior hollow 181 for receiving the second small ends 112, 122 of the first and second vessels 110, 120.

The body 100 further comprises a third vessel 130 that is non-unitary with the first and second vessels 110, 120 and the base 180. The third vessel 130 is attached to the first and second vessels 110, 120 during assembly of the container 1. More specifically, during assembly of the multi-chamber container 1, the first and second vessels 110, 120 are brought into contact with each other, their respective first small ends 111, 121 and orifices 114, 124 are inserted into a receiving hole 131 formed in a first side of the third vessel 130, and their respective second small ends 112, 122 are inserted into the hollow 181 formed in the base 180. Then, the respective first small ends 111, 121 of the first and second vessels 110, 120 are fixed to the third vessel 130, such as by adherence using adhesive or by sonic welding the third vessel 130 to the first and second vessels 110, 120, and the respective second small ends 112, 122 of the first and second vessels 110, 120 are fixed to the base 180, such as by adherence using adhesive or by sonic welding the base 180 to the first and second vessels 110, 120. Accordingly, in the assembled container 1, the first and second storage chambers 113, 123, indeed the first and second vessels 110, 120, are disposed in parallel between the base 180 and the third vessel 130.

Figure 6:
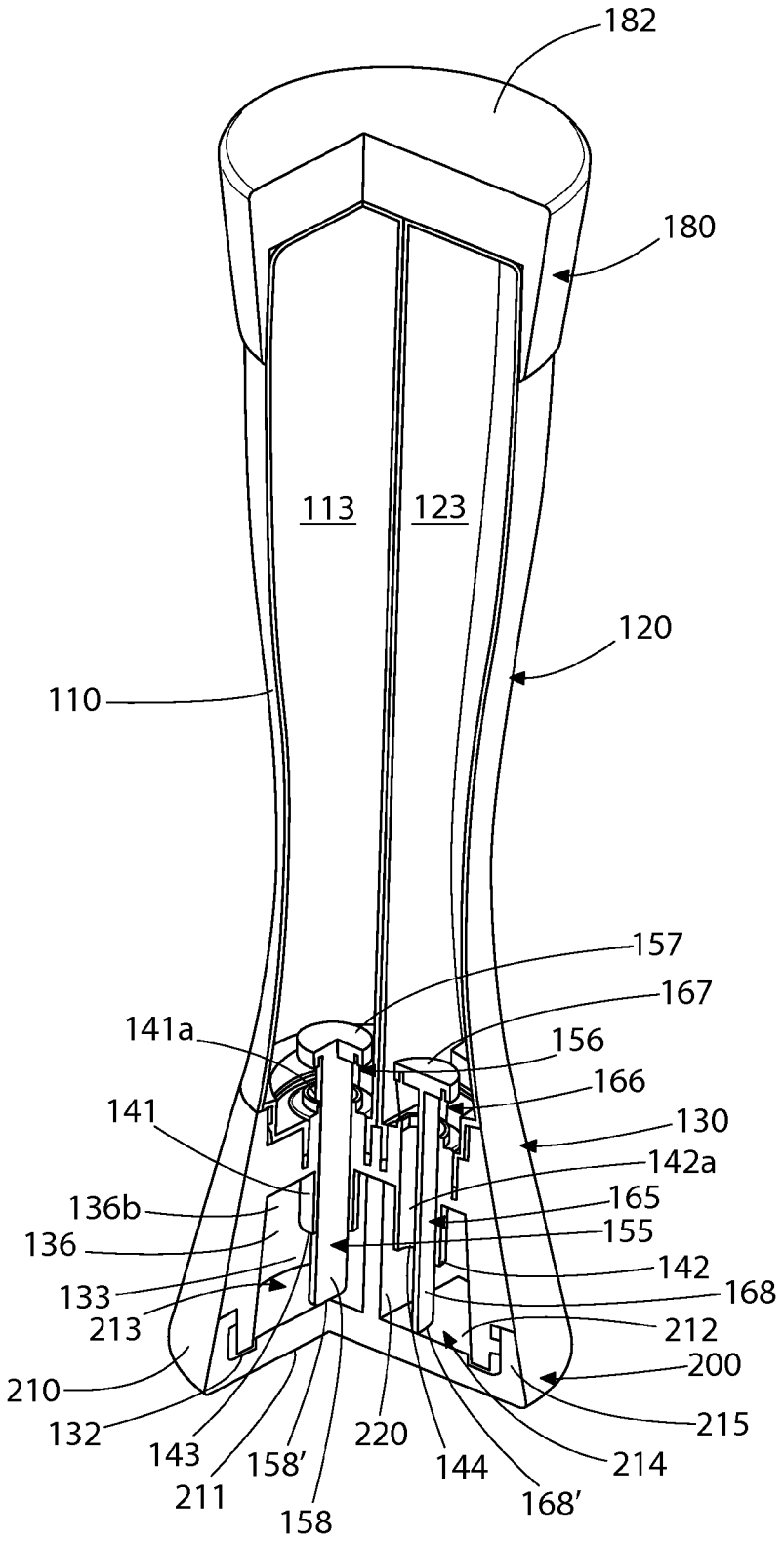
FIG. 6 is a cross sectional view of the multi-chamber container of FIG. 5, shown with the closure of the container at its first, closed position relative to the body of the container.
Figure 7:
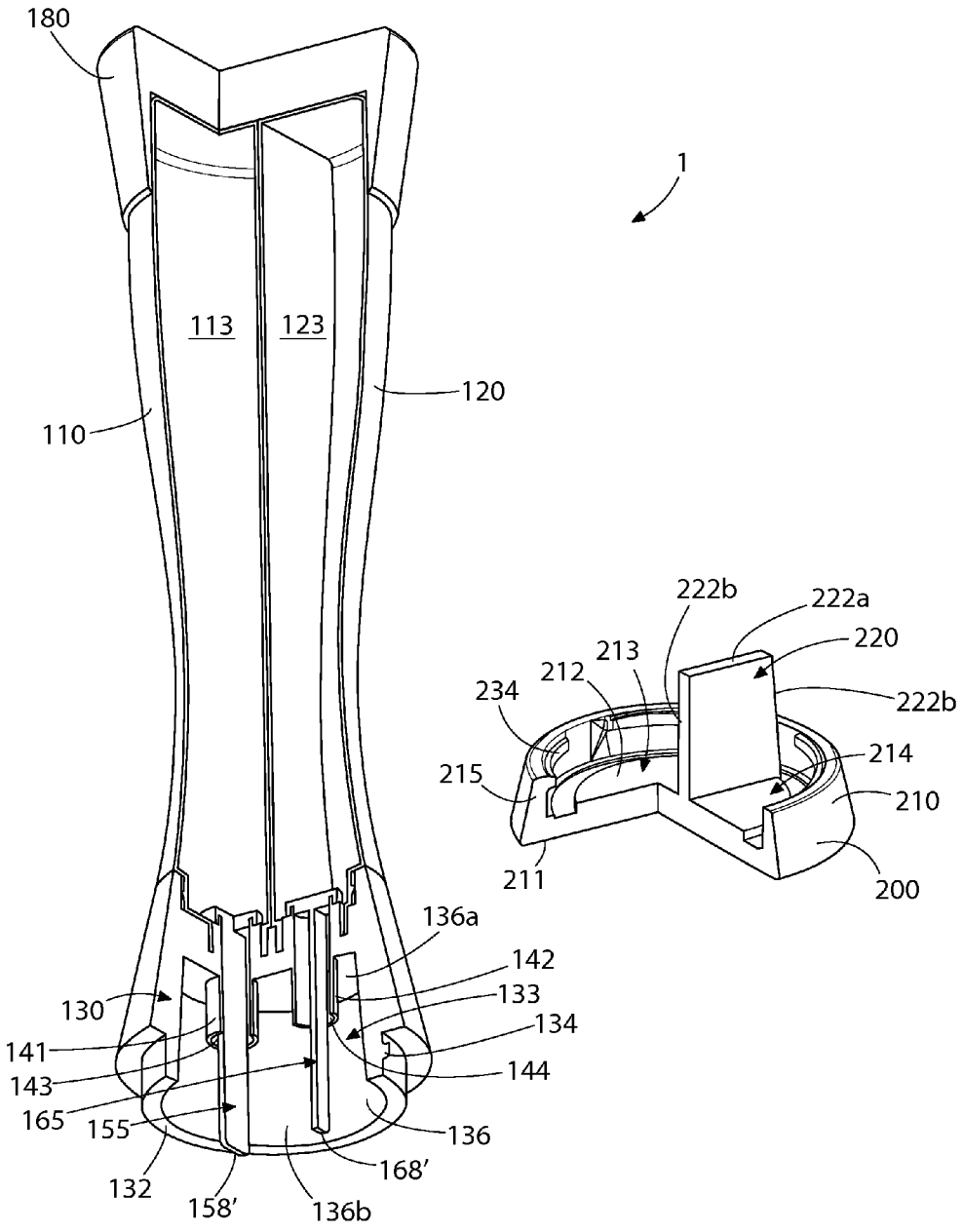
FIG. 7 is a cross sectional view of the multi-chamber container of FIG. 5, shown with the closure of the container at its second, open position relative to the body of the container.

As best shown in FIGS. 6 and 7, the third vessel 130 has a wall 136 defining a mixing chamber 133. In this embodiment, the wall 136 defining the mixing chamber 133 comprises a circular sub-wall 136*a* and a cylindrical sub-wall 136*b* depending from an edge of the circular sub-wall 136*a*. However, in variations to this embodiment, the wall 136 may take a different shape. Indeed, in some embodiments, the wall 136 may be comprised of a set of polygonal sub-walls that together define the mixing chamber 133, or the wall 136 may be substantially hemispherical. The mixing chamber 133 is sized to receive a divider 220 of the closure 200 when the closure 200 is at a first, closed position relative to the body 100, as will be discussed in more detail below. The mixing chamber 133 can be considered to comprise a first portion 133*a* (or first outlet zone 133*a*) and a second portion 133*b* (or second outlet zone 133*b*), with the first and second portions 133*a*, 133*b* together forming the mixing chamber 133. As discussed in more detail below, the divider 220 of the closure 200 has edges 222*a*, 222*b* that cooperate with the sub-walls 136*a*, 136*b* of the wall 136 of the third vessel 130 when the closure 200 is at the first, closed position, to isolate the first portion 133*a* of the mixing chamber 133 from the second portion 133*b* of the mixing chamber 133.

In a variation to this embodiment, the wall 136 has a groove 137 for receiving the edges 222*a*, 222*b* of the divider 220 of the closure 200 when the closure 200 is at a first, closed position relative to the body 100.

With reference to both FIGS. 6 and 7, first and second protrusions 141, 142 protrude into the mixing chamber 133. The first protrusion 141 is part of a first inlet that fluidly connects the first storage chamber 113 with the mixing chamber 133, while the second protrusion 142 is part of a second inlet that fluidly connects the second storage chamber 123 with the mixing chamber 133. More specifically, the first inlet fluidly connects the first storage chamber 113 with the first portion 133*a* (or first outlet zone) of the mixing chamber 133, while the second inlet fluidly connects the second storage chamber 123 with the second portion 133*b* of the mixing chamber 133, particularly when the divider 220 isolates the first portion 133*a* from the second portion 133*b*.

The first protrusion 141 has a first internal passage 141*a* in fluid communication with the first storage chamber 113, which first internal passage 141*a* opens into the mixing chamber 133 at a first opening 143 in the first protrusion 141 at a position spaced from the wall 136, while the second protrusion 142 has a second internal passage 142*a* in fluid communication with the second storage chamber 123, which second internal passage 142*a* opens into the mixing chamber 133 at a second opening 144 in the second protrusion 142 at a position spaced from the wall 136.

Figure 4:
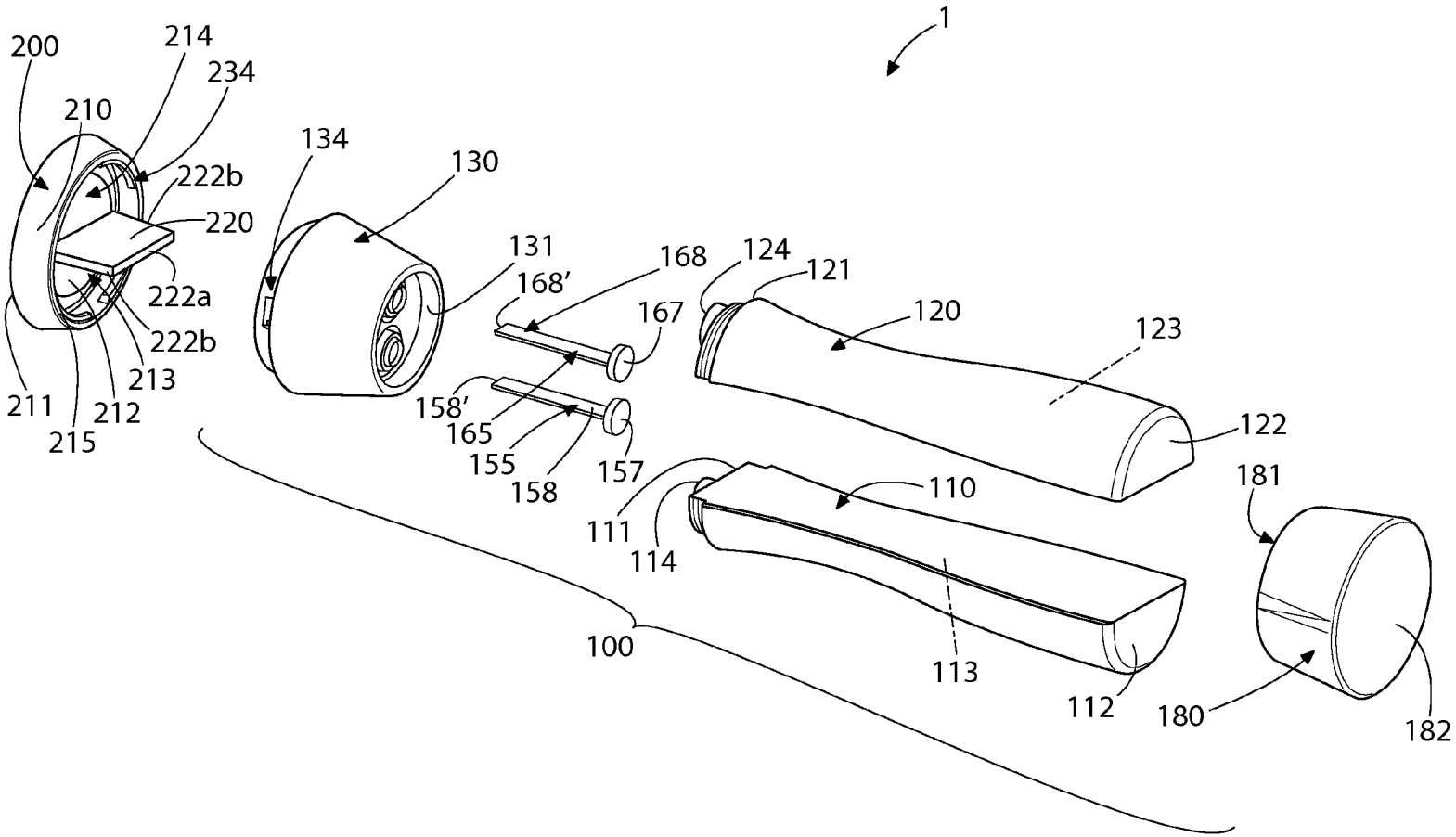
FIG. 4 is an exploded view of components of a multi-chamber container according to a second embodiment of the present invention.

As shown in FIGS. 4, 6 and 7, the container 1 further comprises a first member 155 disposed in the first internal passage 141*a* of the first protrusion 141 and movable between a closed position, at which the first member 155 seals the first inlet to isolate the first storage chamber 113 from the first outlet zone 133*a*, and an open position, at which the first storage chamber 113 is in fluid communication with the first outlet zone 133*a*. Similarly, the container 1 comprises a second member 165 disposed in the second internal passage 142*a* of the second protrusion 142 and movable between a closed position, at which the second member 165 seals the second inlet to isolate the second storage chamber 123 from the second outlet zone 133*b*, and an open position, at which the second storage chamber 123 is in fluid communication with the second outlet zone 133*b*.

The first member 155 comprises a first piston having a piston head 157 and a blade 158 depending from the piston head 157. The piston head 157 is connected to the first inlet by a rubber band 156 or other resilient element, which biases the first member 155 to its closed position relative to the first inlet. However, when the closure 200 is at its first, closed position (as shown in FIG. 6), the first member 155 is prevented from moving relative to the first inlet to its closed position, because an end 158' of the blade 158 contacts an interior side 212 of the closure 200. Accordingly, when the closure 200 is at its first, closed, position, the first member 155 is held at its open position, and the first portion 133*a* of the mixing chamber 133 is maintained in fluid communication with the first storage chamber 113. It will be noted that the blade 158 defines and separates two separate paths in the first internal passage 141*a*, to permit flow of the first flowable substance in a direction from the first storage chamber 113 to the first portion 133*a* of the mixing chamber 133 via one of the paths, and simultaneous flow of air from the first portion 133*a* of the mixing chamber 133 to the first storage chamber 113 via the other of the paths, when the first member 155 is at its open position. However, when the closure 200 is at its second, open position, the first member 155 no longer contacts the closure 200 and so is movable to its closed position to seal the first inlet under the biasing force of the resilient element 156.

Similarly, the second member 165 comprises a second piston having a piston head 167 and a blade 168 depending from the piston head 167. The piston head 167 is connected to the second inlet by a rubber band 166 or other resilient element, which biases the second member 165 to its closed position relative to the second inlet. However, when the closure 200 is at its first, closed position (as shown in FIG. 6), the second member 165 is prevented from moving relative to the second inlet to its closed position, because an end 168' of the blade 168 contacts the interior side 212 of the closure 200. Accordingly, when the closure 200 is at its first, closed position, the second member 165 is held at its open position, and the second portion 133*b* of the mixing chamber 133 is maintained in fluid communication with the second storage chamber 123. It will be noted that the blade 168 defines and separates two separate paths in the second internal passage 142*a*, to permit flow of the second flowable substance in a direction from the second storage chamber 123 to the second portion 133*b* of the mixing chamber 133 via one of the paths, and simultaneous flow of air from the second portion 133*b* of the mixing chamber 133 to the second storage chamber 123 via the other of the paths, when the second member 165 is at its open position. However, when the closure 200 is at its second, open position, the second member 165 no longer contacts the closure 200 and so is movable to its closed position to seal the second inlet under the biasing force of the resilient element 166.

With the closure 200 in the first, closed position, the volume of the first portion 133*a* of the mixing chamber 133 is equal (or substantially equal) to a first predetermined volume of the first flowable substance to be dispensed from the container 1, and the volume of the second portion 133*b* of the mixing chamber 133 is equal (or substantially equal) to a second predetermined volume of the second flowable substance to be dispensed from the container 1. Accordingly, as will be described further below, the container 1 comprises a first apparatus configured, on operation thereof, to dispense from the first storage chamber 113 via the first inlet into the first portion 133*a* (or first outlet zone) of the mixing chamber 133 a first predetermined volume of the first flowable substance, and a second apparatus configured, on operation thereof, to dispense from the second storage chamber 123 via the second inlet into the second portion 133*b* (or second outlet zone) of the mixing chamber 133 a second predetermined volume of the second flowable substance.

As mentioned above, the container 1 further comprises a closure 200. The closure 200 is detachably attached to the body 100 through a screw thread 134 of the third vessel 130 that cooperates with a screw thread 234 of the closure 200. The closure 200 is movable relative to the third vessel 130 and the rest of the body 100.

The closure 200 has a main portion 210 having a first exterior side 211 and the interior side 212, and the divider 220 extending from the interior side 212. The divider 220 has a first straight edge 222*a* that cooperates with the wall 136, more specifically the circular sub-wall 136*a*, of the third vessel 130 when the closure 200 is at the first, closed position, and a pair of second outer edges 222*b* that cooperate with the wall 136, more specifically the cylindrical sub-wall 136*b*, of the third vessel 130 when the closure 200 is at the first, closed position.

The closure 200 is detachable from the body 100 to move the closure 200 from the first, closed position to the second, open position, and the closure 200 comprises a first cavity 213 and a second cavity 214, with the divider 220 separating the first cavity 213 from the second cavity 214. The first cavity 213 is defined by the combination of a first portion of the interior side 212, a first portion of an annular outer wall 215 of the main portion 210, and one side of the divider 220, while the second cavity 214 is defined by the combination of a second portion of the interior side 212, a second portion of the annular outer wall 215, and another side of the divider 220. The first cavity 213 of the closure 200 has a first volume equal to or greater than the first predetermined volume and the second cavity 214 of the closure 200 has a second volume equal to or greater than the second predetermined volume. When the closure 200 is at the first, closed position, the first portion 133*a* (or first outlet zone) of the mixing chamber 133 is in fluid communication with the first cavity 213 of the closure 200 and the second portion 133*b* (or second outlet zone) a the mixing chamber 133 is in fluid communication with the second cavity 214 of the closure 200.

The closure 200 is movable relative to the body 100 between the first, closed position (see FIGS. 5 and 6) and the second, open position (see FIG. 7). The cooperating screw threads 134, 234 of the third vessel 130 and closure 200 together act as a lock for locking the closure 200 at the first, closed position. When the closure 200 is at the first, closed position, the closure 200 is not movable away from the third vessel 130 without being rotated relative to the third vessel 130. The closure 200 is rotatable relative to the third vessel 130 to disengage the cooperating screw threads 134, 234 to permit movement of the closure 200 relative to the body 100 to the second, open position. Rotation through about 15 to 30 degrees is required to release the lock. Other forms of lock for locking the closure 200 at the first, closed position may instead be provided.

When the closure 200 is at the closed, position, the main portion 210 of the closure 200 creates a seal with a rim or lip 132 of the third vessel 130 around an opening of the mixing chamber 133 to isolate the mixing chamber 133 from an exterior of the container 1. Moreover, when the closure 200 is at the first, closed position, the divider 220 is disposed in the mixing chamber 133 with the edges 222*a*, 222*b* of the divider 220 contacting the respective sub-walls 136*a*, 136*b*, and the divider 220 isolates the first portion 133*a* of the mixing chamber 133 from the second portion 133*b* of the mixing chamber 133. Furthermore, when the closure 200 is at the first, closed position, the entire closure 200, including the divider 220, is spaced from the first and second inlets, i.e. from the first and second protrusions 141, 142 and their respective openings 143, 144, so as to permit flow of the first flowable substance from the first storage chamber 113 via the opening 143 of the first protrusion 141 into the first portion 133*a* of the mixing chamber 133, and so as to permit flow of the second flowable substance from the second storage chamber 123 via the opening 144 of the second protrusion 142 into the second portion 133*b* of the mixing chamber 133.

On the other hand, when the closure 200 is at the second, open position, the main portion 210 of the closure 200 is separated from the rim or lip 132 of the third vessel 130, and the mixing chamber 133 is in fluid communication with the exterior of the container 1. Moreover, when the closure 200 is at the second, open position, the closure 200 is detached from the third vessel 130 and the rest of the body 100, the mixing chamber 133 is free of the divider 220, and the first portion 133*a* of the mixing chamber 133 is in fluid communication with the second portion 133*b* of the mixing chamber 133.

Figure 5:
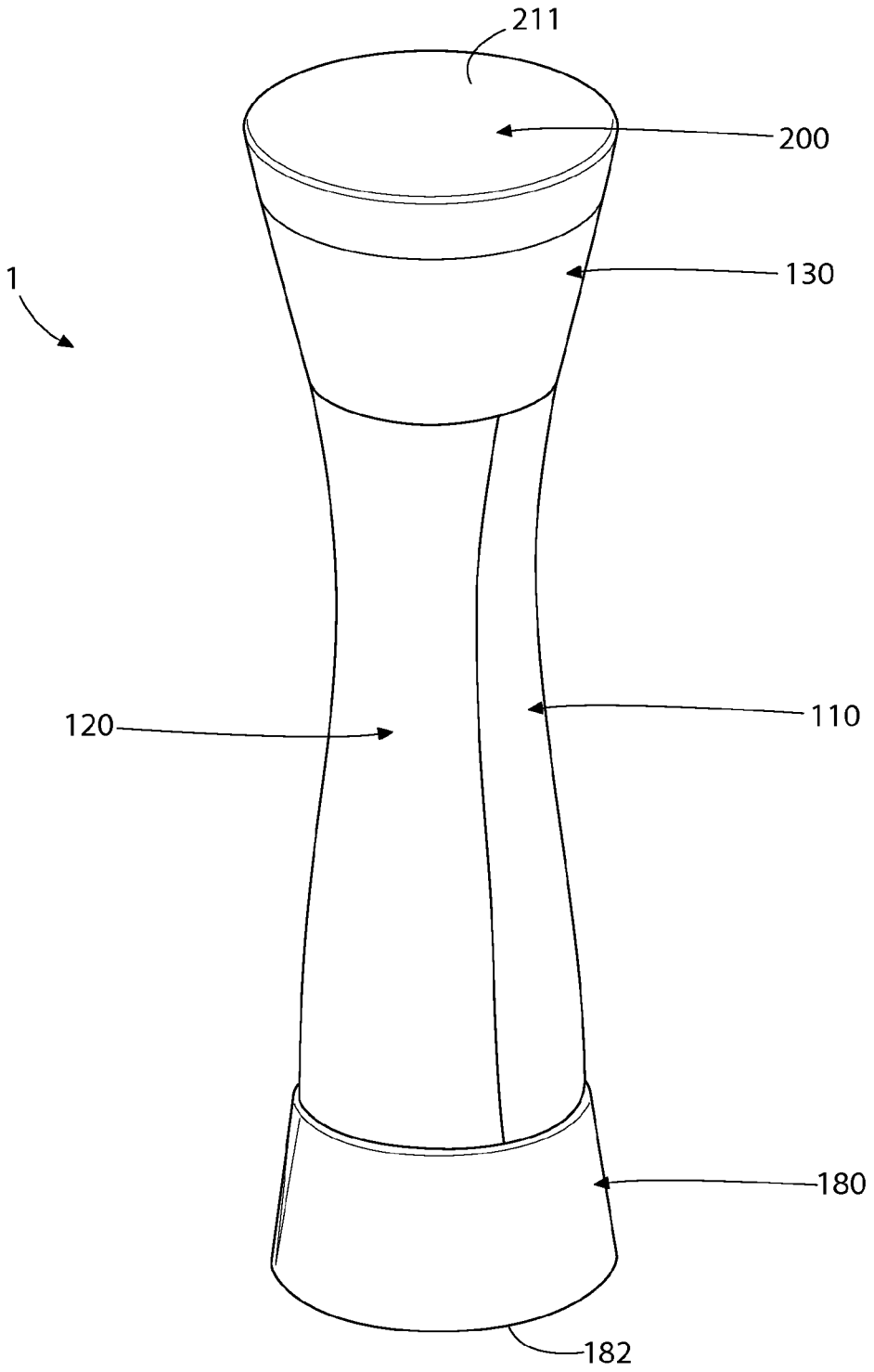
FIG. 5 is a perspective view showing the components of FIG. 4 assembled to form the multi-chamber container according to the second embodiment of the present invention, shown with the closure of the container at its first, closed position relative to the body of the container.

When a user wishes to dispense the first and second flowable substances from the container of the second embodiment, they first ensure that the closure 200 is at the first, closed position and that the screw threads 134, 234 are mating to engage the lock, as shown in FIG. 5. As discussed above, in this configuration, the first and second members 155, 165 are retained in their open positions.

The user then ensures that the container 1 is in a state with the closure 200 lower than, i.e. below, the base 180 and with the container 1 in a horizontal state, that is with the base end 182 of the container 1 horizontal. This causes the first and second flowable substances to flow out from the respective first and second storage chambers 113, 123 under the influence of gravity, through the respective first and second orifices 114, 124, through the respective first and second internal passages 141*a*, 142*a* and respective first and second openings 143, 144 of the first and second protrusions 141, 142 of the first and second inlets, and into the respective first and second portions 133*a*, 133*b* of the mixing chamber 133, which first and second portions 133*a*, 133*b* of the mixing chamber 133 are isolated from each other by the divider 220 of the closure 200. The volumes of the first and second portions 133*a*, 133*b* of the mixing chamber 133 dictate the respective predetermined volumes of the first and second flowable substances that are dispensed into the first and second portions 133*a*, 133*b*.

While maintaining the container 1 in the horizontal state with the closure 200 lower than, i.e. below, the base 180, the user then rotates the closure 200 relative to the third vessel 130 to release the lock. The user then quickly but steadily moves the closure 200 downwards and away from the third vessel 130, to allow the first and second members 155, 165 to move to their closed positions under the influence of the resilient elements 156, 166, which cuts off the flow of the first and second flowable substances to the first and second portions 133*a*, 133*b* of the mixing chamber 133. Simultaneously, the first predetermined volume of the first flowable substance disposed within the first portion 133*a* of the mixing chamber 133 becomes retained within the first cavity 213 of the closure 200, and the second predetermined volume of the second flowable substance disposed within the second portion 133*b* of the mixing chamber 133 becomes retained within the second cavity 214 of the closure 200. The divider 220 of the closure 200 keeps the first and second flowable substances separate from each other in the closure 200.

While the foregoing description discusses the use of the container 1 in a horizontal state, it is understood that the user may also use the container 1 even if the container 1 is not in a horizontal state, such as using the container 1 when it is slightly tilted with respect to the base of the container 1.

The user then brings a lip or rim of the closure 200 to their lips, tilts the closure 200, and pours the separate first and second predetermined volumes of the respective first and second flowable substances into their mouth. The closure 200 accordingly is useable as a cup. Alternatively, the user may choose to pour the separate first and second predetermined volumes of the respective first and second flowable substances into a separate receptacle or back into the mixing chamber 133 to allow the first and second flowable substances to mix, and then drink the mixed first and second flowable substances from the receptacle or from the mixing chamber 133.

Accordingly, since the first and second flowable substances are kept separate from each other during the dispensing routine, it is prevented, or the risk is minimized, that any of the first flowable substance is allowed to flow towards the second storage chamber 123 via the second opening 144, and that any of the second flowable substance is allowed to flow towards the first storage chamber 113 via the first opening 143.

While the invention has been described with respect to specific examples including presently preferred modes of carrying out the invention, those skilled in the art will appreciate that there are numerous variations and permutations of the above described systems and techniques. It is to be understood that other embodiments may be utilized and structural and functional modifications may be made without departing from the scope of the present invention. Thus, the scope of the invention should be construed broadly as set forth in the appended claims.

The invention claimed is:

1. A multi-chamber container for dispensing flowable substances, comprising:

a body having:

a first storage chamber for storing a first flowable substance, a second storage chamber for storing a second flowable substance, a mixing chamber, a first inlet that fluidly connects the first storage chamber with a first portion of the mixing chamber, and a second inlet that fluidly connects the second storage chamber with a second portion of the mixing chamber; and a closure having a divider, wherein the closure is movable relative to the body between:

(a) a first position, at which the divider isolates the first portion of the mixing chamber from the second portion of the mixing chamber and the closure is spaced from the first and second inlets, and (b) a second position, at which the first portion of the mixing chamber is in fluid communication with the second portion of the mixing chamber.

2. The container of claim 1 wherein, when the closure is at the first position, the closure isolates the mixing chamber from an exterior of the container.

3. The container of claim 1 wherein, when the closure is at the second position, the mixing chamber is in fluid communication with the exterior of the container.

4. The container of claim 1, wherein an interior wall of the mixing chamber has a groove for receiving a portion of the divider when the closure is at the first position.

5. The container of claim 1 wherein, when the closure is at the second position, the mixing chamber is free of the divider.

6. The container of claim 1, wherein the mixing chamber is defined by a wall, and wherein each of the first and second inlets comprises a protrusion protruding into the mixing chamber, the protrusion having an internal passage in fluid communication with a respective one of the first and second storage chambers, which passage opens into the mixing chamber at an opening formed in the protrusion at a position spaced from the wall.

7. The container of claim 1 wherein, when the closure is at the second position, the closure is attached to the body.

8. The container of claim 7, wherein the closure is attached to the body by a hinge.

9. The container of claim 1 wherein, when the closure is at the second position, the closure is detached from the body.

10. The container of claim 1, comprising a lock for locking the closure at the first position.

11. The container of claim 1, comprising a first dip tube extending from the first inlet to the first storage chamber and a second dip tube extending from the second inlet to the second storage chamber.

12. The container of claim 1, wherein the first and second storage chambers are defined by respective first and second vessels that are squeezable by a user to cause the first and second flowable substances to flow into the mixing chamber.

13. The container of claim 1, wherein the first and second storage chambers are defined by respective non-unitary first and second vessels, and the mixing chamber is defined by a third vessel that is non-unitary with the first and second vessels and is attached to the first and second vessels.

14. The container of claim 13, wherein the container comprises a base that is non-unitary with the first and second vessels, wherein the first and second vessels are disposed between the third vessel and the base.

15. The container of claim 14, wherein the first and second vessels are disposed in parallel between the third vessel and the base.

16. The container of claim 1, comprising a first member movable between a closed position, at which the first member seals the first inlet to isolate the first storage chamber from the mixing chamber, and an open position, at which the first storage chamber is in fluid communication with the mixing chamber, a second member movable between a closed position, at which the second member seals the second inlet to isolate the second storage chamber from the mixing chamber, and an open position, at which the second storage chamber is in fluid communication with the mixing chamber, and wherein, when the closure is at the first position, the first and second members are prevented from moving to their respective closed positions.

17. The container of claim 16, wherein, when the closure is at the first position, the closure contacts the first and second members to prevent the first and second members from moving to their respective closed positions.

18. The container of claim 16 wherein, when the closure is at the second position, the first and second members are movable to their respective closed positions.

19. The container of claim 16, wherein the first and second members are biased to their respective closed positions.

20. The container of claim 16, wherein the first member comprises a first piston disposed in the first inlet and the second member comprises a second piston disposed in the second inlet.

21. The container of claim 1, comprising a first apparatus configured, on operation thereof, to dispense from the first storage chamber via the first inlet into the first portion of the mixing chamber a first predetermined volume of the first flowable substance, and a second apparatus configured, on operation thereof, to dispense from the second storage chamber via the second inlet into the second portion of the mixing chamber a second predetermined volume of the second flowable substance.

22. The container of claim 1, wherein the closure comprises a first cavity and a second cavity, and wherein the divider separates the first cavity from the second cavity.

23. The container of claim 22 wherein, when the closure is at the first position, the first portion of the mixing chamber is in fluid communication with the first cavity of the closure and the second portion of the mixing chamber is in fluid communication with the second cavity of the closure.

24. The container of claim 23, wherein the first cavity has a first volume equal to or greater than the first predetermined volume, and the second cavity has a second volume equal to or greater than the second predetermined volume.

* * * * *